US009833823B2

(12) United States Patent
Sprock

(10) Patent No.: US 9,833,823 B2
(45) Date of Patent: Dec. 5, 2017

(54) METHOD FOR PRODUCING A METAL STRIP

(71) Applicant: SMS group GMBH, Düsseldorf (DE)

(72) Inventor: August Sprock, Düsseldorf (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 14/888,787

(22) PCT Filed: Apr. 30, 2014

(86) PCT No.: PCT/EP2014/058935
§ 371 (c)(1),
(2) Date: Nov. 3, 2015

(87) PCT Pub. No.: WO2014/177664
PCT Pub. Date: Nov. 6, 2014

(65) Prior Publication Data

US 2016/0082491 A1 Mar. 24, 2016

(30) Foreign Application Priority Data

May 3, 2013 (DE) ..... 10 2013 208 145
Oct. 17, 2013 (DE) ..... 10 2013 221 072
Nov. 26, 2013 (DE) ..... 10 2013 019 698

(51) Int. Cl.
*B21B 45/02* (2006.01)

(52) U.S. Cl.
CPC ..... *B21B 45/0218* (2013.01); *B21B 2201/06* (2013.01)

(58) Field of Classification Search
CPC ..... B21B 37/44; B21B 37/76; B21B 45/02; B21B 45/0203; B21B 45/0218;
(Continued)

(56) References Cited

U.S. PATENT DOCUMENTS 6,855,218 B1 * 2/2005 Kawalla ..... C21D 8/0226 148/541
7,181,943 B2 2/2007 Seidel
(Continued)

FOREIGN PATENT DOCUMENTS

EP 1935521 A1 6/2008
EP 2450116 A1 5/2012
(Continued)

OTHER PUBLICATIONS

JP 2020-227991A document publication date, Oct. 2010, machine translation supplied Aug. 2, 2016.*
(Continued)

*Primary Examiner* — Edward Tolan
(74) *Attorney, Agent, or Firm* — Lucas & Mercanti, LLP; Klaus P. Stoffel

(57) ABSTRACT

A method for producing a metal strip, in which the strip is rolled in a multi-stand rolling mill, is removed behind the final rolling stand of the rolling mill in the direction of conveyance, and is cooled in a cooling device. The strip or metal sheet is subjected to additional rapid cooling immediately after passing the working rollers of the final rolling stand, wherein the strip or the metal sheet is cooled at least partially within the extent of the final rolling stand in the direction of conveyance, wherein rapid cooling is performed by applying a coolant to the strip or metal sheet from above and from below, wherein the volume flow of coolant that is applied to the strip or metal sheet from below measures at least 120% of the volume flow of coolant that is applied to the strip or metal sheet from above.

9 Claims, 1 Drawing Sheet

(58) Field of Classification Search
CPC . B21B 45/0233; B21B 2201/06; B21B 37/74; C21D 8/0226; C21D 8/0263
See application file for complete search history.

(56) References Cited

U.S. PATENT DOCUMENTS

| | | | | |
|---|---|---|---|---|
| 8,440,133 | B2 | 5/2013 | Eto et al. | |
| 8,500,927 | B2 | 8/2013 | Tachibana et al. | |
| 8,931,321 | B2 * | 1/2015 | Ueoka | B21B 45/0233 72/201 |
| 8,945,319 | B2 | 2/2015 | Tachibana et al. | |
| 9,039,956 | B2 | 5/2015 | Matsumoto et al. | |
| 9,061,335 | B2 | 6/2015 | Serizawa et al. | |
| 9,085,022 | B2 | 7/2015 | Horii et al. | |
| 2012/0068391 | A1 * | 3/2012 | Eto | B21B 45/0218 266/44 |
| 2012/0216924 | A1 | 8/2012 | Ota | |
| 2012/0318414 | A1 * | 12/2012 | Tachibana | B21O 51/00 148/567 |
| 2014/0076018 | A1 * | 3/2014 | Akashi | B21B 37/76 72/201 |

FOREIGN PATENT DOCUMENTS

| | | | |
|---|---|---|---|
| EP | 2455167 | A1 | 5/2012 |
| JP | S60221115 | A | 11/1985 |
| JP | S60243226 | A | 12/1985 |
| JP | S6156722 | A | 3/1986 |
| JP | H11277128 | A | 10/1999 |
| JP | 2005342767 | A | 12/2005 |
| JP | 2006035223 | A | 2/2006 |
| JP | 2006035233 | A | 2/2006 |
| JP | 2009279629 | A | 12/2009 |
| JP | 2010227991 | A | 10/2010 |
| KR | 1020120023692 | A | 3/2012 |
| RU | 1817714 | C | 5/1993 |
| RU | 2281174 | C2 | 8/2006 |
| SU | 988880 | A | 1/1983 |
| TW | 201236779 | A | 9/2012 |
| WO | 02070157 | A1 | 9/2002 |
| WO | 2011001934 | A1 | 1/2011 |
| WO | 2011001935 | A1 | 1/2011 |
| WO | 2011042934 | A1 | 4/2011 |
| WO | 2011065290 | A1 | 6/2011 |
| WO | 2011065291 | A1 | 6/2011 |
| WO | 2011111663 | A1 | 9/2011 |
| WO | 2012039270 | A1 | 3/2012 |
| WO | 2012043148 | A1 | 4/2012 |

OTHER PUBLICATIONS

Korean Office Action, dated Aug. 16, 2016.
Chinese Office Action, dated Jul. 5, 2018.

* cited by examiner

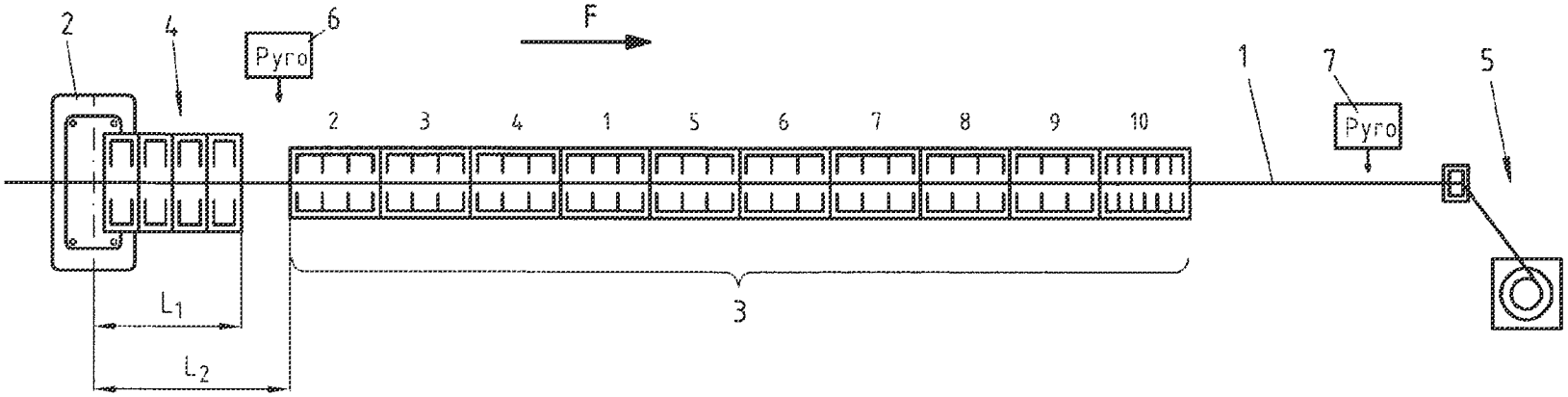
5
7
Pyro
1
10
9
8
7
6
5
1
4
3
2
3
F
6
Pyro
4
2
L1
L2

METHOD FOR PRODUCING A METAL STRIP

The present application is a 371 of International application PCT/EP2014/058935, filed Apr. 30, 2014, which claims priority of DE 10 2013 208 145.6, filed May 3, 2013, DE 10 2013 221 072.8, filed Oct. 17, 2013, and DE 10 2013 019 698.1, filed Nov. 26, 2013, the priority of these applications is hereby claimed and these applications are incorporated herein by reference.

BACKGROUND OF THE INVENTION

The invention relates to a method for producing a metal strip, in which the strip is rolled in a multi-stand rolling mill, is output after the final rolling stand of the rolling mill in the direction of conveyance and is cooled in a cooling device, wherein, immediately after passing the working rolls of the final rolling stand, the strip or plate is subjected to an additional rapid cooling, the cooling of the strip or plate at least partially taking place still within the extent of the final rolling stand in the direction of conveyance, the rapid cooling taking place by a cooling medium being applied to the strip or plate from above and from below.

A method of the type in question is known from US 2012/068391 A1 and from JP S60 243226 A. WO 02/070157 A1 and JP S60 221115 A show other solutions.

The mechanical properties of steel materials can be influenced in various ways. An increase in the strength is achieved by adding certain alloying elements (solid-solution hardening). Furthermore, during the rolling the finishing train temperature may be lowered, in order to achieve a higher dislocation density (dislocation hardening). By alloying with microalloying elements—such as for example Nb, V or Ti—precipitations are formed, causing an increase in the strength (precipitation hardening). However, these mechanisms have the disadvantage that the toughness is adversely influenced. By contrast, a fine grain structure of the microstructure (fine-grain hardening) has a positive effect on the strength properties and at the same time the toughness properties. With a small grain size, the strength and toughness properties of the steel material are improved.

It is typically provided in hot-strip or plate-rolling trains that there is a distance of 12 to 20 m between the final rolling stand and the cooling zone. Generally, measuring devices for the temperature, thickness, profile and flatness are installed in this region. Especially in the case of slowly rolled strips, the time until cooling is achieved can consequently be 12 to 20 seconds (at a strip speed of 1 m/s). However, this has a disadvantageous effect on the grain size of the microstructure within the strip, and consequently on the achievable mechanical properties, since recrystallization and recovery processes occur after the forming process.

It is disadvantageous that after the rolling of the strip or plate there is a pronounced increase in the grain size in the microstructure, with concomitant recrystallization and recovery processes. The increase in grain size leads to a deterioration in the mechanical properties.

A further aspect concerns the flatness of the strip or plate. The lower the temperature after the cooling in the cooling zone and the thicker the strip or plate thickness, the more important the amounts of water applied to the upper side and underside of the strip. If the ratio of the amounts of water between the upper side and the underside is not optimum, the strip or plate becomes unflat or uneven. In this case, laborious reworking or rectification is required.

SUMMARY OF THE INVENTION

The invention is therefore based on the object of providing a method of the type in question that makes better setting of the mechanical properties and the phase constituents of the metallic material, particularly steel, possible, in particular in a hot-strip and plate-rolling train. Furthermore, the degree of flatness of the strip or plate to be produced is intended to be as great as possible.

The way in which this object is achieved by the invention is characterized in that the volumetric flow of cooling medium (i.e. the amount of media or water per unit of time) that is applied to the strip or plate from below is at least 120% of the volumetric flow of cooling medium that is applied to the strip or plate from above.

With preference, the volumetric flow of cooling medium that is applied to the strip or plate from below is at least 150% of the volumetric flow of cooling medium that is applied to the strip or plate from above. On the other hand, the volumetric flow of cooling medium that is applied to the strip or plate from below is preferably at most 400% of the volumetric flow of cooling medium that is applied to the strip or plate from above. It has been found that, with values above 400%, a downward curving of the edges of the strip may occur.

With the rapid cooling of the strip or plate, a cooling medium is preferably applied in such an amount (and if appropriate at such a pressure) that the cooling of the strip or plate at its surface takes place with a gradient of at least 500 K/s, preferably with a gradient of at least 750 K/s, with particular preference with a gradient of at least 1000 K/s.

The strip or plate is preferably produced by a slab first being cast in a continuous casting installation and then heated to a defined temperature in a furnace, in particular in a roller hearth furnace, and immediately after that rolled down to the final strip thickness in the rolling mill acting as the finishing train.

With preference, a steel strip or a steel plate is produced as the strip or plate. In this case, the strip may be a steel strip, to which alloying constituents are added.

The rolling mill is preferably a hot-rolling mill.

The rapid cooling preferably extends from within the final rolling stand of the rolling mill in the direction of conveyance (i.e. in the rolling direction) over a distance of between 2 m and 15 m, preferably between 6 m and 10 m. Meanwhile, the cooling device begins preferably at a distance greater than 10 m after the final rolling stand of the rolling mill in the direction of conveyance.

According to the invention, therefore, a procedure that influences the grain structure and sets a ferrite grain that is as small as possible is proposed. Rapid cooling is arranged in the final stand of the finishing train. The time between the passing of the final roll gap and the cooling of the strip or plate is consequently minimal. With preference, the rapid cooling is designed such that cooling rates above 1000 K/s at the surface are possible. The amounts of water are applied in such a way as to obtain optimum flatness. Measuring instruments (for the thickness of the strip or for the temperature of the same) are arranged after the rapid cooling in the rolling direction or direction of conveyance. Subsequently, the (conventional) laminar cooling and then the coiling of the strip take place.

The present invention allows the improved production of strips and plates, in particular from metallic materials (in particular from steel and iron alloys) in hot-rolling and plate-rolling mills.

The resultant grain structure is the result of the recrystallization and recovery processes occurring in the material during the forming process. An increase in grain size takes place, particularly after the final pass in a hot-strip train or in a plate stand, and can be prevented or reduced by earliest possible cooling of the strip.

The application areas of the present invention are therefore generally rolling mills, hot-strip and plate-rolling mills, the production of strips and plates from steel and iron alloys. The proposed method can be used wherever materials have to be cooled in the production process, in particular in a hot-strip and plate-rolling train with respectively associated units.

Better setting of the mechanical properties and also the phase constituents of the steel, in particular in a hot-strip and plate-rolling train, is advantageously possible. With the optimum distribution of the amounts of water from the upper side and the underside, good flatness is obtained.

The small grain size of the microstructure with improved flatness that is obtained by the method according to the invention is advantageous.

The present invention provides a response to this and describes an arrangement in which rapid cooling follows immediately after the final rolling stand. The rapid cooling has the effect that very high cooling rates are achieved and a small grain size is possible.

From aspects of flatness, it must be ensured that the amounts of water on the upper side and underside of the strip or plate are applied in such a way that a flat strip or plate is obtained. Usually, the ratio of the amounts of water between the upper side and the underside is 1:1 up to 1:1.15. This means that the amounts of water on the upper side and underside are equal or up to 15% more volumetric flow is applied on the underside than on the upper side.

The present invention has meanwhile found that this ratio is disadvantageous for the setting of good flatness. Undulations occur at the edges, so that the edge of the strip no longer lies on the roller table. According to the present invention, this is prevented, and a high degree of flatness achieved, if the ratio of the amounts of water lies in a range between 1:1.2 and 1:4, i.e. at least 120% and up to 400% of the volumetric flow is applied to the underside than is the case on the upper side of the strip.

In the production of hot strip, the slab is first cast in a continuous casting installation, is then heated to the desired furnace temperature in a roller hearth furnace, and immediately after that rolled down to the final strip thickness (hot charging) in the finishing train (rolling mill). The slab may also be heated after a relatively long lying time in the furnace and then processed further in the rolling mill (cold charging). The necessary furnace temperature in this case depends substantially on the final thickness and strip width to be rolled and also on the material of the strip.

Therefore, improved mechanical properties of the strip or plate produced, in particular with a greater strength, are advantageously obtained in this way. The greater strength is a result of the decrease in the grain size according to the Hall-Petch equation.

Furthermore, a greater toughness of the material is also achieved. The greater toughness is a result of the decrease in the grain size according to the Cottrell-Petch equation. This can be measured in the form of a decrease in the DBTT transition temperature (Ductile Brittle Transition Temperature) or by higher values being obtained in the notched-bar flexural impact test.

Changing the mechanical properties may also be accompanied by saving costs on alloying elements. Initial investigations have shown that considerable costs can be saved.

The rapid cooling is an effective tool for improving the mechanical properties by setting a smaller grain size. However, the flatness of the strip or plate is adversely influenced by the great amounts of water that are necessary for setting a high cooling rate. The optimum balance of exposure of the upper side and the underside is of particular importance for this. If the amounts of water are applied in the same ratio, thermal stresses cause a curving of the strip or plate in such a way that the edges of the strip or plate lift up from the roller table. If, however, the amounts of water are adapted in such a way that the same temperatures are obtained on the upper side and the underside of the strip/plate, optimum flatness is achieved, and the edge of the strip/plate lies flat on the roller table in the same way as the middle of the strip. However, for this purpose it is necessary that the amounts of water on the underside are increased.

It has been found that, with an increase in the amount of water on the underside to at least 1.2 times the value of the upper side, particularly good flatness is achieved. A value on the underside that is greater than four times the amount of the upper side however leads to the opposite result. In this case, the strip or plate curves upward in the middle. This effect is also very disadvantageous, since the strip or plate cannot be further processed.

Finally, an optimum flatness is obtained by the ratio of the amounts of water provided according to the invention between the volumetric flow on the upper side and the underside of the strip or plate.

BRIEF DESCRIPTION OF THE DRAWING

An exemplary embodiment of the invention is represented in the drawing. The single FIGURE schematically shows the final stand of a finishing train for producing a steel strip and a following laminar cooling together with a coiling installation.

DETAILED DESCRIPTION OF THE INVENTION

In the FIGURE, the rolling stand 2 of a finishing train can be seen. The strip 1 is rolled in the finishing train and leaves the final rolling stand 2 in the direction of conveyance F. Directly after the roll gap or already in the roll gap of the final rolling stand 2, the strip 1 is cooled, for which purpose rapid cooling 4 is used, corresponding in structural terms to the classic type of construction. A cooling medium (water) is sprayed onto the upper side and underside of the strip 1.

After the rapid cooling 4 there follows a classic cooling device 3 in the form of a laminar cooling. In the exemplary embodiment, the cooling device 3 is divided into 10 portions.

It is also worth mentioning that the length $L_1$ of the rapid cooling 4 in the exemplary embodiment runs to about 9 m from the middle of the rolling stand 2; as described, the rapid cooling begins immediately after or in the roll gap of the final rolling stand 2.

Meanwhile, in the exemplary embodiment the distance $L_2$ of the cooling device 3, i.e. its beginning, lies about 14 m after the middle of the rolling stand 2.

After the cooling device 3 there is a coiling device 5 for winding up the now finished strip.

Temperature measuring elements 6 and 7 (pyrometers) determine the respective temperature at the corresponding location, in order to be able to monitor the progress of the process.

It is achieved that the strength and the extension under strain of the strip (or of the plate) are increased at the same time, which is due to the small grain size that is achieved when the proposed method is used. After the rolling of the strip in the hot-strip train, an increase in the grain size takes place immediately after the recrystallization. This can be prevented if the temperature of the strip is reduced as quickly as possible after the rolling to a range in which an increase in the grain size no longer takes place. The strip must therefore be cooled from the final rolling temperature, which lies at about 800° C. to 920° C., on average at 860° C., to at least 700° C.

With preference, the proposed method is used in combination with a CSP plant with X strands, oscillation and use of the tunnel furnace, or in a conventional hot-rolling mill.

Special materials, for example microalloyed grades, may be used.

A combination with a plate-rolling mill may also be provided.

LIST OF DESIGNATIONS

1 Strip
2 Rolling stand
3 Cooling device
4 Rapid cooling
5 Coiling device
6 Temperature measuring element
7 Temperature measuring element
F Direction of conveyance
$L_1$ Length of the rapid cooling
$L_2$ Distance of the cooling device

The invention claimed is:

1. A method for producing a metal strip or plate, in which the strip or plate is rolled in a multi-stand rolling mill, is output after the final rolling stand of the rolling mill in the direction of conveyance and is cooled in a cooling device, wherein, immediately after passing the working rolls of the final rolling stand, the strip or plate is subjected to an additional rapid cooling, the cooling of the strip or plate at least partially taking place still within the extent of the final rolling stand in the direction of conveyance, the rapid cooling taking place by a cooling medium being applied to the strip or plate from above and from below, wherein during rapid cooling the volumetric flow of cooling medium that is applied to the strip or plate from below is at least 200% of the volumetric flow of cooling medium that is applied to the strip or plate from above, wherein, with the rapid cooling of the strip or plate, a cooling medium is applied in such an amount and/or at such a pressure that the cooling of the strip or plate at its surface takes place with a gradient of at least 500 K/s and wherein the rapid cooling extends from within the final rolling stand of the rolling mill in the direction of conveyance over a distance of between 2 m and 15 m, and wherein the cooling device begins at a distance of at least 10 m after the final rolling stand of the rolling mill in the direction of conveyance.

2. The method as claimed in claim 1, wherein the volumetric flow of cooling medium that is applied to the strip or plate from below is at most 400% of the volumetric flow of cooling medium that is applied to the strip or plate from above.

3. The method as claimed in claim 1, wherein, with the rapid cooling of the strip or plate, a cooling medium is applied in such an amount and/or at such a pressure that the cooling of the strip or plate at its surface takes place with a gradient of at least 750 K/s.

4. The method as claimed in claim 3, wherein, with the rapid cooling of the strip or plate, a cooling medium is applied in such an amount and/or at such a pressure that the cooling of the strip or plate at its surface takes place with a gradient of at least 1000 K/s.

5. The method as claimed in claim 1, wherein the strip or plate is produced by a thin slab first being cast in a continuous casting installation, this then being heated to a defined temperature in a furnace, and immediately after that rolled down to the final strip thickness in the rolling mill acting as the finishing train.

6. The method as claimed in claim 5, wherein the furnace is a roller hearth furnace.

7. The method as claimed in claim 1, wherein a steel strip or a steel plate is produced as the strip or plate.

8. The method as claimed in claim 1, wherein the rapid cooling extends from within the final rolling stand of the rolling mill in the direction of conveyance over a distance of between 6 m and 10 m.

9. The method as claimed in claim 1, wherein the cooling device begins at a distance of at least 13 m after the final rolling stand of the rolling mill in the direction of conveyance.

* * * * *